US008245797B2

(12) United States Patent
Jurica et al.

(10) Patent No.: US 8,245,797 B2
(45) **Date of Patent: *Aug. 21, 2012**

(54) CUTTING STRUCTURES FOR CASING COMPONENT DRILLOUT AND EARTH-BORING DRILL BITS INCLUDING SAME

(75) Inventors: Chad T. Jurica, Spring, TX (US); Scott F. Donald, The Woodlands, TX (US); Adam R. Williams, Conroe, TX (US)

(73) Assignee: Baker Hughes Incorporated, Houston, TX (US)

( * ) Notice: Subject to any disclaimer, the term of this patent is extended or adjusted under 35 U.S.C. 154(b) by 229 days.

This patent is subject to a terminal disclaimer.

(21) Appl. No.: 12/604,899

(22) Filed: Oct. 23, 2009

(65) Prior Publication Data

US 2010/0187011 A1 Jul. 29, 2010

Related U.S. Application Data

(63) Continuation-in-part of application No. 12/030,110, filed on Feb. 12, 2008, now Pat. No. 7,954,571.

(60) Provisional application No. 60/976,968, filed on Oct. 2, 2007.

(51) Int. Cl.
*E21B 10/43* (2006.01)

(52) U.S. Cl. ..... 175/57; 175/425; 175/431

(58) Field of Classification Search ..... 175/57, 175/425, 431

See application file for complete search history.

(56) References Cited

U.S. PATENT DOCUMENTS

| | | | |
|---|---|---|---|
| 1,342,424 | A | 6/1920 | Cotten |
| 1,981,525 | A | 11/1934 | Price |
| 1,997,312 | A | 4/1935 | Satre |
| 2,215,913 | A | 9/1940 | Brown |
| 2,334,788 | A | 11/1943 | O'Leary |
| 2,869,825 | A | 1/1959 | Crawford |
| 2,940,731 | A | 6/1960 | Poole |
| 3,266,577 | A | 8/1966 | Turner |
| 3,367,430 | A | 2/1968 | Rowley |
| 3,565,192 | A | 2/1971 | McLarty |
| 3,624,760 | A | 11/1971 | Bodine |
| 3,997,009 | A | 12/1976 | Fox |
| 4,190,383 | A | 2/1980 | Pryke et al. |

(Continued)

FOREIGN PATENT DOCUMENTS

| | | |
|---|---|---|
| CA | 1222448 | 6/1987 |

(Continued)

OTHER PUBLICATIONS

Baker Oil Tools Drill Down Float Shoes, 6 pages, various dates prior to May 23, 1997.

(Continued)

*Primary Examiner* — William P Neuder
*Assistant Examiner* — Blake Michener
(74) *Attorney, Agent, or Firm* — TraskBritt

(57) ABSTRACT

An earth-boring tool includes a bit body having a face on which two different types of cutters are disposed, the first type being cutting elements suitable for drilling at least one subterranean formation and the second type suitable for drilling through at least one elastomeric component of a casing string, as well as a casing shoe and cement. Methods of drilling with an earth-boring tool include engaging and drilling an elastomeric component using at least one abrasive cutting structure.

20 Claims, 6 Drawing Sheets

U.S. PATENT DOCUMENTS 4,255,165 A 3/1981 Dennis et al.
4,351,401 A 9/1982 Fielder
4,397,361 A * 8/1983 Langford, Jr. ..... 175/428
4,413,682 A 11/1983 Callihan et al.
4,618,010 A 10/1986 Falgout, Sr. et al.
4,624,316 A * 11/1986 Baldridge et al. ..... 166/325
4,673,044 A 6/1987 Bigelow et al.
4,682,663 A 7/1987 Daly et al.
4,759,413 A 7/1988 Bailey et al.
4,782,903 A 11/1988 Strange
4,842,081 A 6/1989 Parant
4,956,238 A 9/1990 Griffin
5,025,874 A 6/1991 Barr et al.
5,027,912 A 7/1991 Juergens
5,062,865 A 11/1991 Chen et al.
5,127,482 A 7/1992 Rector, Jr.
5,135,061 A 8/1992 Newton, Jr.
5,168,941 A 12/1992 Krueger et al.
5,186,265 A 2/1993 Henson et al.
5,259,469 A 11/1993 Stjernstrom et al.
5,271,472 A 12/1993 Leturno
5,285,204 A 2/1994 Sas-Jaworsky
5,289,889 A 3/1994 Gearhart et al.
5,311,954 A 5/1994 Quintana
5,314,033 A 5/1994 Tibbitts
5,322,139 A 6/1994 Rose et al.
5,341,888 A 8/1994 Deschutter
5,379,835 A * 1/1995 Streich ..... 166/181
5,402,856 A 4/1995 Warren et al.
5,423,387 A 6/1995 Lynde
5,443,565 A 8/1995 Strange, Jr.
5,450,903 A 9/1995 Budde
5,497,842 A 3/1996 Pastusek et al.
5,531,281 A 7/1996 Murdock
5,533,582 A 7/1996 Tibbitts
5,605,198 A 2/1997 Tibbitts et al.
5,697,442 A 12/1997 Baldridge
5,706,906 A 1/1998 Jurewicz et al.
5,720,357 A 2/1998 Fuller et al.
5,765,653 A 6/1998 Doster et al.
5,787,022 A 7/1998 Tibbitts et al.
5,842,517 A * 12/1998 Coone ..... 166/156
5,887,655 A 3/1999 Haugen et al.
5,887,668 A * 3/1999 Haugen et al. ..... 175/79
5,950,747 A 9/1999 Tibbitts et al.
5,957,225 A 9/1999 Sinor
5,960,881 A * 10/1999 Allamon et al. ..... 166/291
5,979,571 A 11/1999 Scott et al.
5,992,547 A 11/1999 Caraway et al.
6,009,962 A 1/2000 Beaton
6,021,859 A 2/2000 Tibbitts et al.
6,050,354 A 4/2000 Pessier et al.
6,062,326 A 5/2000 Strong et al.
6,063,502 A 5/2000 Sue et al.
6,065,554 A 5/2000 Taylor et al.
6,073,518 A 6/2000 Chow et al.
6,098,730 A 8/2000 Scott et al.
6,131,675 A 10/2000 Anderson
6,216,805 B1 4/2001 Lays et al.
6,298,930 B1 10/2001 Sinor et al.
6,340,064 B2 1/2002 Fielder et al.
6,360,831 B1 3/2002 Akesson et al.
6,394,200 B1 5/2002 Watson et al.
6,401,820 B1 6/2002 Kirk et al.
6,408,958 B1 6/2002 Isbell et al.
6,412,579 B2 7/2002 Fielder
6,415,877 B1 7/2002 Fincher et al.
6,439,326 B1 8/2002 Huang et al.
6,443,247 B1 9/2002 Wardley
6,460,631 B2 10/2002 Dykstra et al.
6,497,291 B1 12/2002 Szarka
6,510,906 B1 1/2003 Richert et al.
6,513,606 B1 2/2003 Krueger
6,540,033 B1 4/2003 Sullivan et al.
6,543,312 B2 4/2003 Sullivan et al.
6,568,492 B2 5/2003 Thigpen et al.
6,571,886 B1 6/2003 Sullivan et al.
6,606,923 B2 8/2003 Swatson et al.
6,612,383 B2 * 9/2003 Desai et al. ..... 175/61
6,620,308 B2 9/2003 Gilbert
6,620,380 B2 9/2003 Thomas et al.
6,622,803 B2 9/2003 Harvey et al.
6,626,251 B1 9/2003 Sullivan et al.
6,648,081 B2 11/2003 Fincher et al.
6,655,481 B2 12/2003 Findley et al.
6,659,173 B2 12/2003 Kirk et al.
6,672,406 B2 1/2004 Beuershausen
6,702,040 B1 3/2004 Sensenig
6,702,045 B1 3/2004 Elsby
6,708,769 B2 3/2004 Haugen et al.
6,747,570 B2 6/2004 Beique et al.
6,779,613 B2 8/2004 Dykstra et al.
6,779,951 B1 8/2004 Vale et al.
6,817,633 B2 11/2004 Brill et al.
6,848,517 B2 2/2005 Wardley
6,857,487 B2 2/2005 Galloway
6,926,099 B2 8/2005 Thigpen et al.
6,943,697 B2 9/2005 Ciglenec et al.
6,953,096 B2 10/2005 Gledhill et al.
6,983,811 B2 1/2006 Wardley
7,025,156 B1 * 4/2006 Caraway ..... 175/426
7,036,611 B2 5/2006 Radford et al.
7,044,241 B2 5/2006 Angman
7,048,081 B2 5/2006 Smith et al.
7,066,253 B2 6/2006 Baker
7,096,982 B2 8/2006 McKay et al.
7,100,713 B2 9/2006 Tulloch
7,117,960 B2 10/2006 Wheeler et al.
7,131,504 B2 11/2006 Odell, II et al.
7,137,460 B2 11/2006 Slaughter et al.
7,178,609 B2 * 2/2007 Hart et al. ..... 175/61
7,204,309 B2 4/2007 Segura et al.
7,216,727 B2 5/2007 Wardley
7,367,410 B2 5/2008 Sangesland
7,395,882 B2 7/2008 Oldham et al.
7,748,475 B2 * 7/2010 McClain et al. ..... 175/57
7,836,978 B2 * 11/2010 Scott ..... 175/426
7,954,571 B2 * 6/2011 McClain et al. ..... 175/431
2002/0020565 A1 2/2002 Hart et al.
2002/0121393 A1 * 9/2002 Thigpen et al. ..... 175/431
2004/0245020 A1 12/2004 Giroux et al.
2005/0145417 A1 7/2005 Radford et al.
2005/0152749 A1 7/2005 Anres et al.
2006/0070771 A1 * 4/2006 McClain et al. ..... 175/57
2007/0079995 A1 4/2007 McClain et al.
2007/0289782 A1 12/2007 Clark et al.
2008/0308276 A1 12/2008 Scott
2009/0084608 A1 4/2009 McClain et al.

FOREIGN PATENT DOCUMENTS

CA 2411856 A1 12/2001
DE 4432710 C1 4/1996
EP 0028121 A1 5/1981
EP 1006260 B1 4/2004
GB 2086451 A 5/1982
GB 2170528 A 8/1986
GB 2345503 A 7/2000
GB 2351987 A 1/2001
GB 2396870 A 7/2004
WO 9325794 A1 12/1993
WO 9628635 A1 9/1996
WO 9813572 A1 4/1998
WO 9936215 A1 7/1999
WO 9937881 A2 7/1999
WO 0050730 A1 8/2000
WO 0142617 A1 6/2001
WO 0146550 A1 6/2001
WO 01/83932 A1 11/2001
WO 0194738 A1 12/2001
WO 0246564 A2 6/2002
WO 03087525 A1 10/2003
WO 2004001180 A1 12/2003
WO 2004076800 A1 9/2004
WO 2004097168 A1 11/2004
WO 2005071210 A1 8/2005
WO 2005083226 A1 9/2005

OTHER PUBLICATIONS

Caledus BridgeBUSTER Product Information Sheet, 3 pages, 2004.
Downhole Products plc, Davis-Lynch, Inc. Pen-o-trator, 2 pages, no date indicated.
Greg Galloway Weatherford International, "Rotary Drilling with Casing—A Field Proven Method of Reducing Wellbore Construction Cost," World Oil Casing Drilling Technical Conference, Mar. 6-7, 2003, pp. 1-7.
International Search Report, dated Jul. 15, 2005 (6 pages).
McKay et al, New Developments in the Technology of Drilling with Casing: Utilizing a Displaceable DrillShoe Tool, World Oil Casing Drilling Technical Conference, Mar. 6-7, 2003, pp. 1-11.
Partial International Search Report dated May 27, 2005 (6 pages).
PCT International Search Report for PCT Application No. PCT/US2006/036855, mailed Feb. 1, 2007.
PCT International Search Report for PCT Application No. PCT/US2007/011543, mailed Nov. 19, 2007.
PCT International Search Report, mailed Feb. 2, 2009, for International Application No. PCT/US2008/066300.
Ray Oil Tool, The Silver Bullet Float Shoes & Collars, 2 pages, no date indicated.
Weatherford Cementation Products, BBL Reamer Shoes, 4 pages, 1998.
Written Opinion of the International Searching Authority, dated Jul. 15, 2005 (11 pages).
International Search Report for International Application No. PCT/US2010/053043 mailed May 27, 2011, 4 pages.
International Written Opinion for International Application No. PCT/US2010/053043 mailed May 27, 2011, 4 pages.

* cited by examiner

CUTTING STRUCTURES FOR CASING COMPONENT DRILLOUT AND EARTH-BORING DRILL BITS INCLUDING SAME

CROSS-REFERENCE TO RELATED APPLICATIONS

The present application is a continuation-in-part of U.S. patent application Ser. No. 12/030,110, filed Feb. 12, 2008, now U.S. Pat. No. 7,954,571, issued Jun. 7, 2011, which claims the benefit of U.S. Provisional Patent Application Ser. No. 60/976,968, filed Oct. 2, 2007, the disclosures of each of which are incorporated herein in their entirety by reference.

TECHNICAL FIELD

Embodiments of the present disclosure relate generally to drilling a subterranean bore hole. More specifically, some embodiments relate to drill bits and tools for drilling subterranean formations and having a capability for drilling out structures and materials, which may be located at, or proximate to, the end of a casing or liner string, such as a casing bit or shoe, cementing equipment components and cement before drilling a subterranean formation. Other embodiments relate to drill bits and tools for drilling through the side wall of a casing or liner string and surrounding cement before drilling an adjacent formation. Still further embodiments relate to drill bits and tools particularly suitable for drilling out casing components comprising rubber or other elastomeric elements.

BACKGROUND

Drilling wells for oil and gas production conventionally employs longitudinally extending sections, or so-called "strings," of drill pipe to which, at one end, is secured a drill bit of a larger diameter. After a selected portion of the bore hole has been drilled, a string of tubular members of smaller diameter than the bore hole, known as casing, is placed in the bore hole. Subsequently, the annulus between the wall of the bore hole and the outside of the casing is filled with cement. Therefore, drilling and casing according to the conventional process typically requires sequentially drilling the bore hole using a drill string with a drill bit attached thereto, removing the drill string and drill bit from the bore hole, and disposing and cementing a casing into the bore hole. Further, often after a section of the bore hole is lined with casing and cemented, additional drilling beyond the end of the casing or through a sidewall of the casing may be desired. In some instances, a string of smaller tubular members, known as a liner string, is run and cemented within previously run casing. As used herein, the term "casing" includes tubular members in the form of liners.

Because sequential drilling and running a casing or liner string may be time consuming and costly, some approaches have been developed to increase efficiency, including the use of reamer shoes disposed on the end of a casing string and drilling with the casing itself. Reamer shoes employ cutting elements on the leading end that can drill through modest obstructions and irregularities within a bore hole that has been previously drilled, facilitating running of a casing string and ensuring adequate well bore diameter for subsequent cementing. Reamer shoes also include an end section manufactured from a material which is readily drillable by drill bits. Accordingly, when cemented into place, reamer shoes usually pose no difficulty to a subsequent drill bit to drill through. For instance, U.S. Pat. No. 6,062,326 to Strong et al. discloses a casing shoe or reamer shoe in which the central portion thereof may be configured to be drilled through. However, the use of reamer shoes requires the retrieval of the drill bit and drill string used to drill the bore hole before the casing string with the reamer shoe is run into the bore hole.

Drilling with casing is effected using a specially designed drill bit, termed a "casing bit," attached to the end of the casing string. The casing bit functions not only to drill the earth formation, but also to guide the casing into the bore hole. The casing string is, thus, run into the bore hole as it is drilled by the casing bit, eliminating the necessity of retrieving a drill string and drill bit after reaching a target depth where cementing is desired. While this approach greatly increases the efficiency of the drilling procedure, further drilling to a greater depth must pass through or around the casing bit attached to the end of the casing string.

In the case of a casing shoe, reamer shoe or casing bit that is drillable, further drilling may be accomplished with a smaller diameter drill bit and casing string attached thereto that passes through the interior of the first casing string to drill the further section of hole beyond the previously attained depth. Of course, cementing and further drilling may be repeated as necessary, with correspondingly smaller and smaller tubular components, until the desired depth of the wellbore is achieved.

However, drilling through conventional casing and casing associated components (e.g., casing shoes, reamer shoes, casing bits, casing wall, cementing equipment, cement, etc.) often results in damage to the subsequent drill bit and bottom-hole assembly deployed or reduced penetration for at least some period of time. For example, conventional drill bits often include very drilling resistant, robust structures typically manufactured from materials that are difficult to drill through, such as tungsten carbide, polycrystalline diamond, or steel. Furthermore, conventional float shoes, such as casing shoes or reamer shoes, may include casing-associated components that are difficult to drill out, such as rubber or other elastomeric components. Such elastomeric components may, in some situations, cause the drill bit to spin on top of the elastomeric component in the casing component being drilled out instead of being broken up and drilled out, preventing the cutting elements of the drill bit from engaging the borehole surface and inhibiting the drill bit from progressing into the formation. In other situations, conventional drill bits and conventional cutting elements may break the elastomeric components into pieces of sufficient size to plug up the passages for evacuating such cuttings from the drill bit and resulting in what is known as "balling" of the drill bit. For example, the larger pieces of elastomeric components may get caught in the junk slots of a conventional bit, making the conventional bit unable to effectively evacuate cuttings from the bit face, which results in collection of cuttings and debris that inhibit the drill bit from drilling through the remainder of the casing component and progressing efficiently into the formation.

It would be desirable to have a drill bit or tool capable of drilling through casing or casing-associated components, particularly those incorporating elastomers, while at the same time offering the subterranean drilling capabilities of a conventional drill bit or tool employing superabrasive cutting elements.

BRIEF SUMMARY

Various embodiments of the present disclosure are directed toward earth-boring tools for drilling through elastomeric casing components and associated material. In one embodiment, an earth-boring tool of the present disclosure may comprise a body having a face at a leading end thereof. A plurality of cutting elements may be disposed on the face. A plurality of abrasive cutting structures may be disposed over the body and positioned in association with at least some of the plurality of cutting elements. The plurality of abrasive cutting structures may comprise a composite material comprising a plurality of carbide particles in a matrix material. The plurality of abrasive cutting structures may include a relative exposure that is sufficiently greater than a relative exposure of at least some of the plurality of cutting elements to enable such abrasive cutting structures to engage and at least partially penetrate into an elastomeric component while at least substantially inhibiting the plurality of cutting elements from engaging the surface of the elastomeric component.

Further embodiments of the present disclosure are directed toward methods of drilling with an earth-boring tool. In one or more embodiments, such methods may comprise engaging and drilling an elastomeric component using at least one of an elongated abrasive cutting structure and a plurality of wear knots. The at least one of an elongated abrasive cutting structure and a plurality of wear knots may comprise a composite material comprising a plurality of hard particles exhibiting a substantially rough surface in a matrix material. Subsequently, a subterranean formation adjacent the first material may be engaged and drilled using a plurality of cutting elements.

In additional embodiments, such methods may comprise comminuting an elastomeric component into sufficiently small pieces to enable flushing away the pieces from a face of the earth-boring tool using a plurality of abrasive cutting structures comprising a plurality of hard particles exhibiting a substantially rough surface in a matrix material.

DETAILED DESCRIPTION

Figure 1:
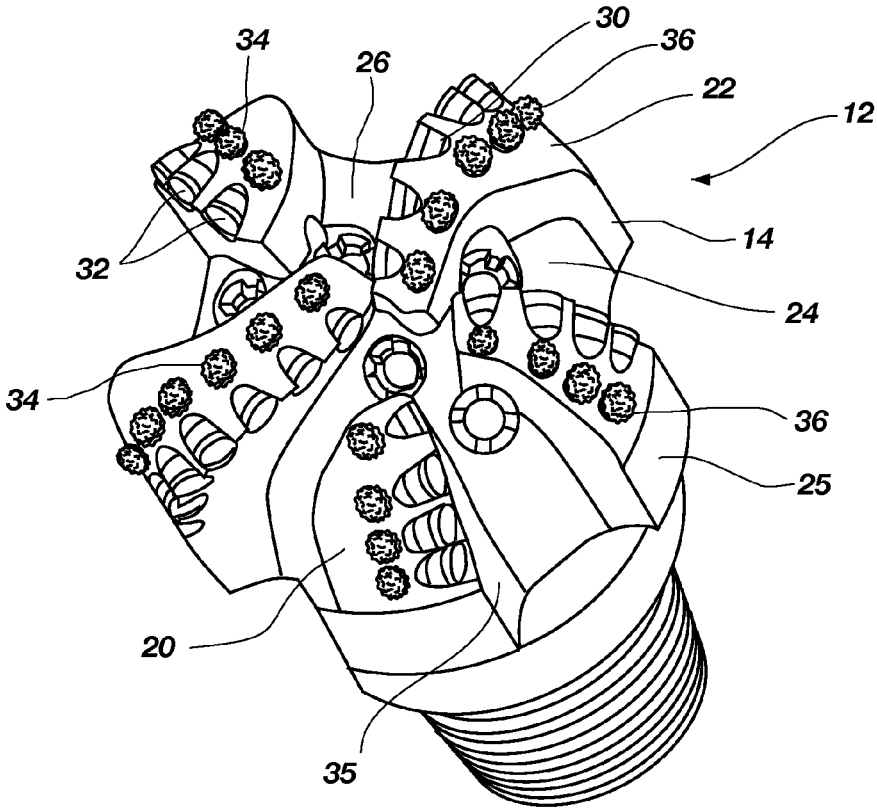
FIG. 1 shows a perspective view of an embodiment of a drill bit of the present disclosure.

The illustrations presented herein are, in some instances, not actual views of any particular cutting element, cutting structure, or drill bit, but are merely idealized representations which are employed to describe the present disclosure. Additionally, elements common between figures may retain the same numerical designation.

FIGS. 1-5 and 8-10 illustrate several variations and embodiments of a drill bit 12 in the form of a fixed cutter or so-called "drag" bit, according to the present disclosure. For the sake of clarity, like numerals have been used to identify like features in FIGS. 1-5 and 8-10. As shown in FIGS. 1-5 and 8-10, drill bit 12 includes a body 14 having a face 26 and generally radially extending blades 22, forming fluid courses 24 therebetween extending to junk slots 35 between circumferentially adjacent blades 22. Body 14 may comprise a tungsten carbide matrix or a steel body, both as well-known in the art. Blades 22 may also include pockets 30, which may be configured to receive cutting elements of one type, such as, for instance, superabrasive cutting elements in the form of polycrystalline diamond compact (PDC) cutting elements 32. Generally, such a PDC cutting element may comprise a superabrasive (diamond) mass that is bonded to a substrate. Rotary drag bits employing PDC cutting elements have been employed for several decades. PDC cutting elements are typically comprised of a disc-shaped diamond "table" formed on and bonded under an ultra-high-pressure and high-temperature (HPHT) process to a supporting substrate formed of cemented tungsten carbide (WC), although other configurations are known. Drill bits carrying PDC cutting elements, which, for example, may be brazed into pockets in the bit face, pockets in blades extending from the face, or mounted to studs inserted into the bit body, are known in the art. Thus, PDC cutting elements 32 may be affixed upon the blades 22 of drill bit 12 by way of brazing, welding, or as otherwise known in the art. If PDC cutting elements 32 are employed, they may be back raked at a common angle, or at varying angles. By way of non-limiting example, PDC cutting elements 32 may be back raked at 15° within the cone of the bit face proximate the centerline of the bit, at 20° over the nose and shoulder, and at 30° at the gage. It is also contemplated that cutting elements 32 may comprise suitably mounted and exposed natural diamonds, thermally stable polycrystalline diamond compacts, cubic boron nitride compacts, or diamond grit-impregnated segments, as known in the art and as may be selected in consideration of the hardness and abrasiveness of the subterranean formation or formations to be drilled.

Also, each of blades 22 may include a gage region 25 which is configured to define the outermost radius of the drill bit 12 and, thus the radius of the wall surface of a borehole drilled thereby. Gage regions 25 comprise longitudinally upward (as the drill bit 12 is oriented during use) extensions of blades 22, extending from nose portion 20 and may have wear-resistant inserts or coatings, such as cutting elements in the form of gage trimmers of natural or synthetic diamond, hardfacing material, or both, on radially outer surfaces thereof as known in the art.

Drill bit 12 may also be provided with abrasive cutting structures 36 of another type different from the cutting elements 32. Abrasive cutting structures 36 may comprise a composite material comprising a plurality of hard particles in a matrix. The plurality of hard particles may comprise a carbide material such as tungsten (W), Ti, Mo, Nb, V, Hf, Ta, Cr, Zr, Al, and Si carbide, or a ceramic. The plurality of particles may comprise one or more of coarse, medium or fine particles comprising substantially rough, jagged edges. By way of example and not limitation, the plurality of particles may comprise sizes selected from the range of sizes including ½-inch particles to particles fitting through a screen having 30 openings per square inch (30 mesh). Particles comprising sizes in the range of ½ inch to 3⁄16 inch may be termed "coarse" particles, while particles comprising sizes in the range of 3/16 inch to 1/16 inch may be termed "medium" particles, and particles comprising sizes in the range of 10 mesh to 30 mesh may be termed "fine" particles. The rough, jagged edges of the plurality of particles may be formed as a result of forming the plurality of particles by crushing the material of which the particles are formed. In some embodiments of the present disclosure the hard particles may comprise a plurality of crushed sintered tungsten carbide particles comprising sharp, jagged edges. The tungsten carbide particles may comprise particles in the range of about ½ inch to about 3/16 inch, particles within or proximate such a size range being termed "coarse sized" particles. The matrix material may comprise a high strength, low melting point alloy, such as a copper alloy. The material may be such that in use, the matrix material may wear away to constantly expose new pieces and rough edges of the hard particles, allowing the rough edges of the hard particles to more effectively engage the casing components and associated material. In some embodiments of the present disclosure, the copper alloy may comprise a composition of copper, zinc and nickel. By way of example and not limitation, the copper alloy may comprise approximately 48% copper, 41% zinc, and 10% nickel by weight.

A non-limiting example of a suitable material for abrasive cutting structures 36 includes a composite material manufactured under the trade name KUTRITE® by B & W Metals Co., Inc. of Houston, Tex. The KUTRITE® composite material comprises crushed sintered tungsten carbide particles in a copper alloy having an ultimate tensile strength of 100,000 psi. Furthermore, KUTRITE® is supplied as composite rods and has a melting temperature of 1785° F., allowing the abrasive cutting structures 36 to be formed using oxyacetylene welding equipment to weld the cutting structure material in a desired position on the drill bit 12. The abrasive cutting structures 36 may, therefore, be formed and shaped while welding the material onto the blades 22. Another non-limiting example of a suitable material for abrasive cutting structures 36 includes a composite material manufactured under the trade name SUPERLOY® by Baker Oil Tools. In some embodiments, the abrasive cutting structures 36 may be disposed directly on exterior surfaces of blades 22. In other embodiments, pockets or troughs 34 may be formed in blades 22 which may be configured to receive the abrasive cutting structures 36.

Figure 2:
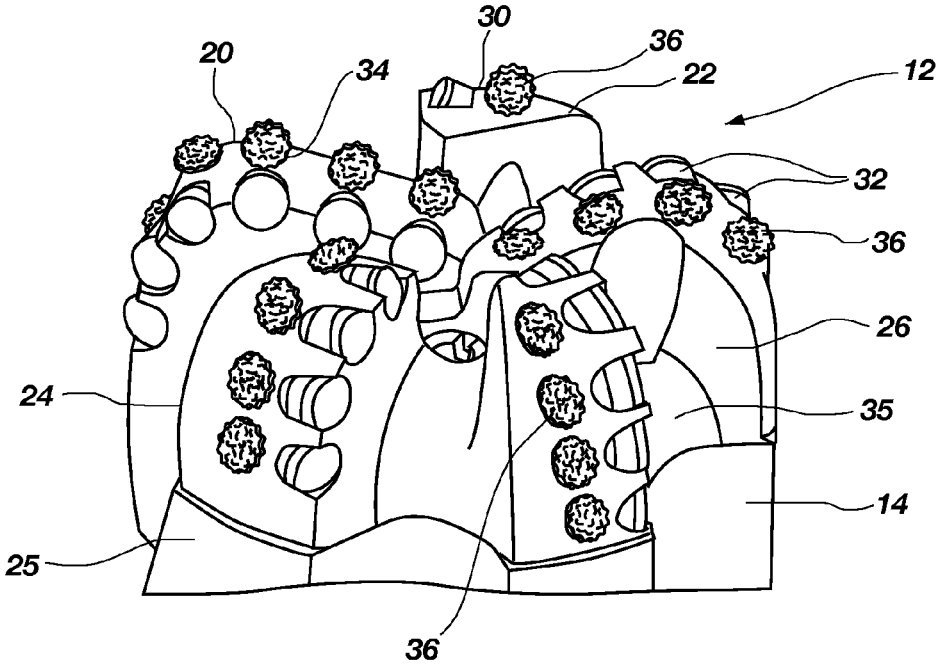
FIG. 2 shows an enlarged perspective view of a portion of the embodiment of FIG. 1.
Figure 3:
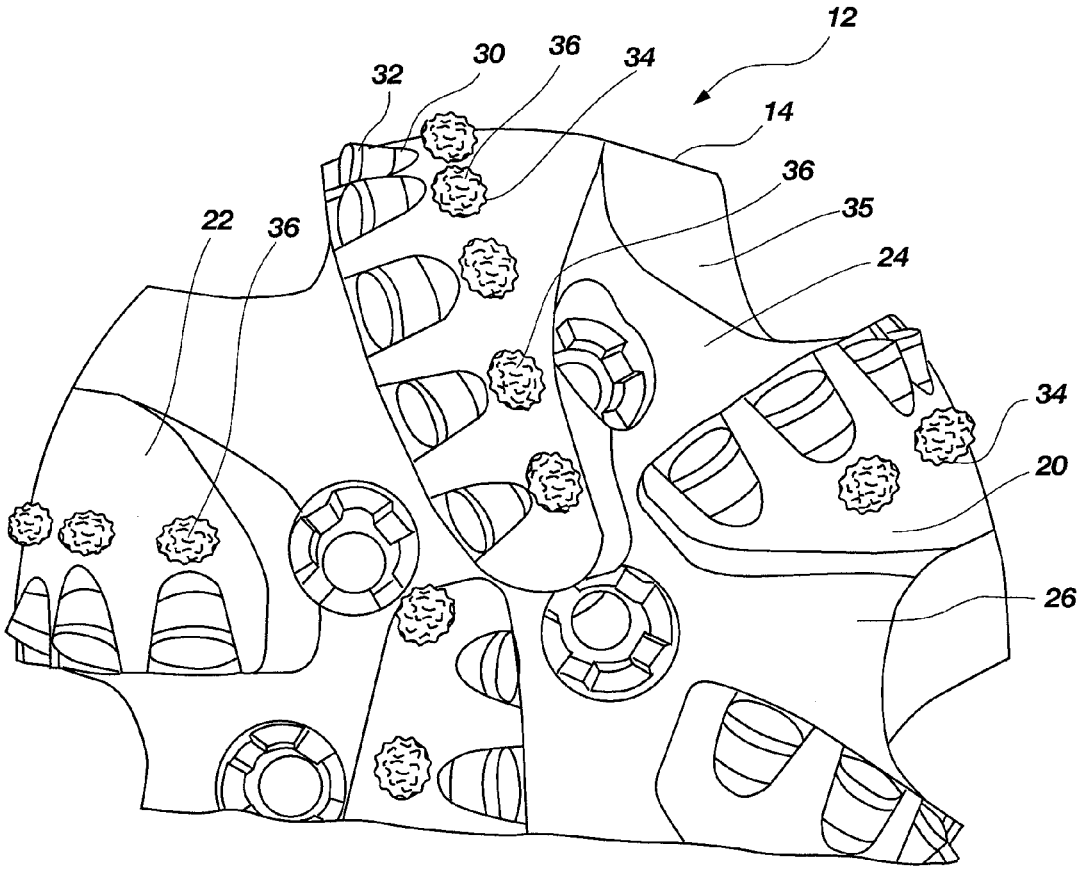
FIG. 3 shows an enlarged view of the face of the drill bit of FIG. 1.
Figure 8:
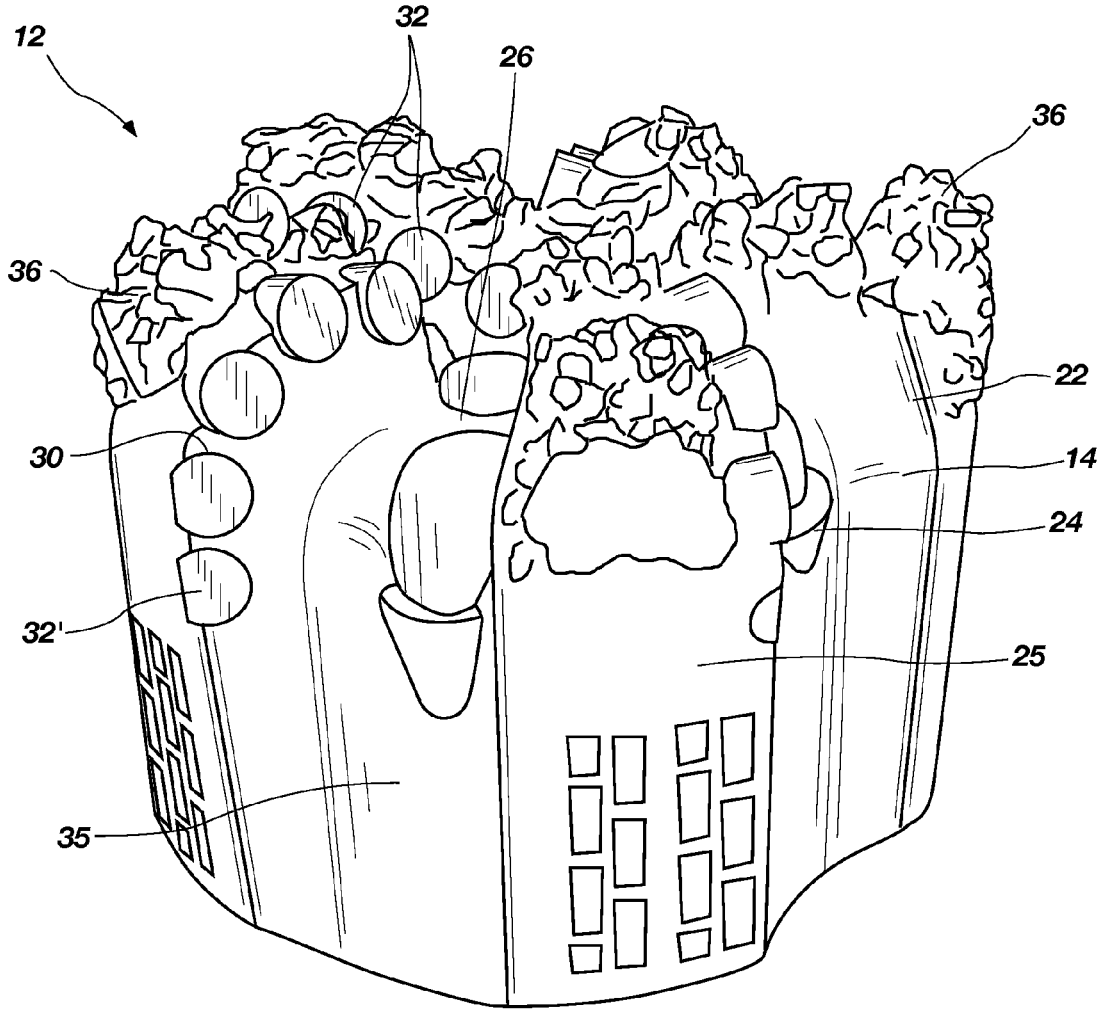
FIG. 8 shows a perspective view of another embodiment of a drill bit of the present disclosure.
Figure 9:
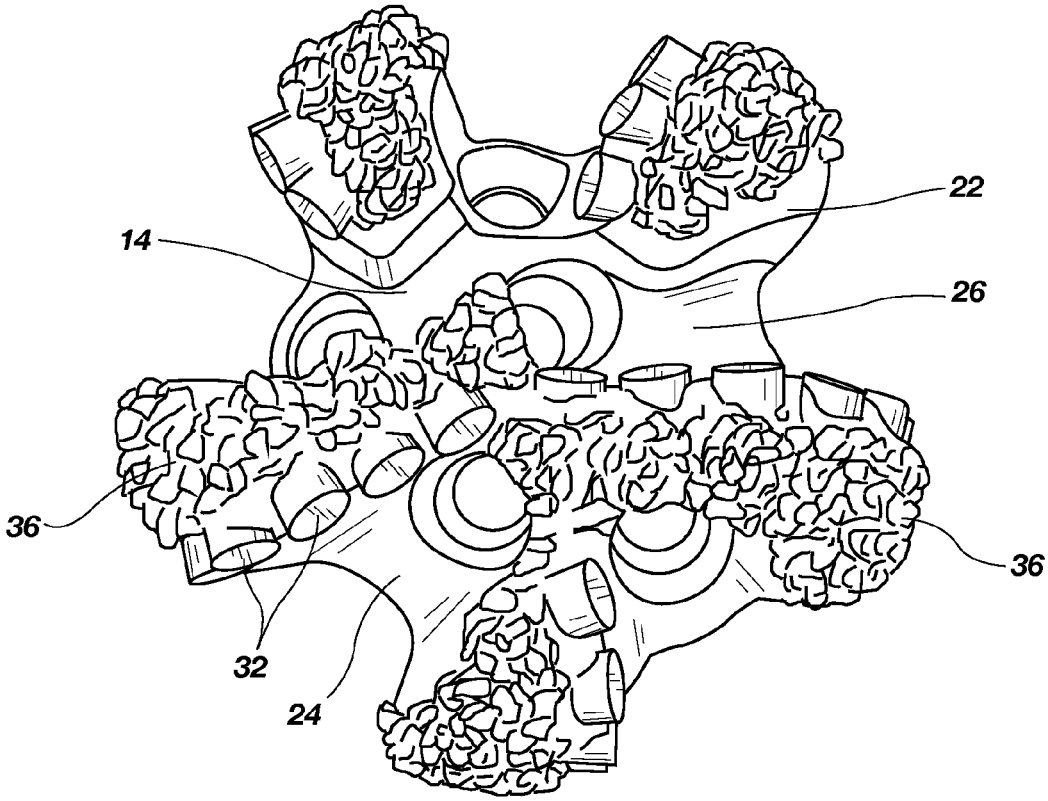
FIG. 9 shows a plan view illustrating the face of the embodiment of the drill bit of FIG. 8.
Figure 10:
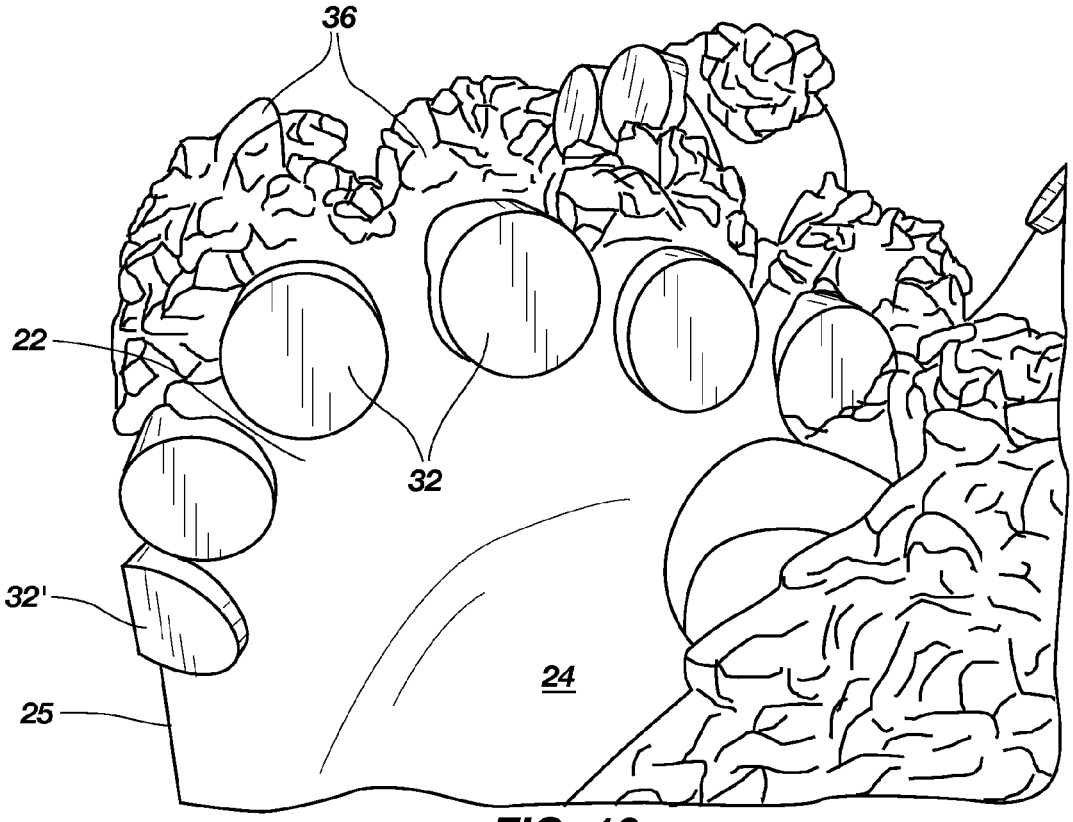
FIG. 10 shows an enlarged perspective view of a portion of the face of the embodiment of the drill bit of FIG. 8.

In some embodiments, as shown in FIGS. 1-3 and in at least portions of FIGS. 8-10, abrasive cutting structures 36 may comprise a protuberant lump or wear knot structure, wherein a plurality of abrasive cutting structures 36 are positioned adjacent one another along blades 22. The wear knot structures may be formed by welding the material, such as from a composite rod like that described above with relation to the KUTRITE®, in which the matrix material comprising the abrasive cutting structures is melted onto the desired location. In other words, the matrix material may be heated to its melting point and the matrix material with the hard particles is, therefore, allowed to flow onto the desired surface of the blades 22. Melting the material onto the surface of the blade 22 may require containing the material to a specific location and/or to manually shape the material into the desired shape during the application process. In some embodiments, the wear knots may comprise a pre-formed structure and may be secured to the blade 22 by brazing. Regardless whether the wear knots are pre-formed or formed directly on the blades 22, the wear knots may be formed to comprise any suitable shape, which may be selected according to the specific application. By way of example and not limitation, the wear knots may comprise a generally cylindrical shape, a post shape, or a semi-spherical shape. Some embodiments may have a substantially flattened top and others may have a pointed or chisel-shaped top as well as a variety of other configurations. The size and shape of the plurality of hard particles may form a surface that is rough and jagged, which may aid in cutting through the casing and casing-associated components such as elastomeric components.

Figure 4:
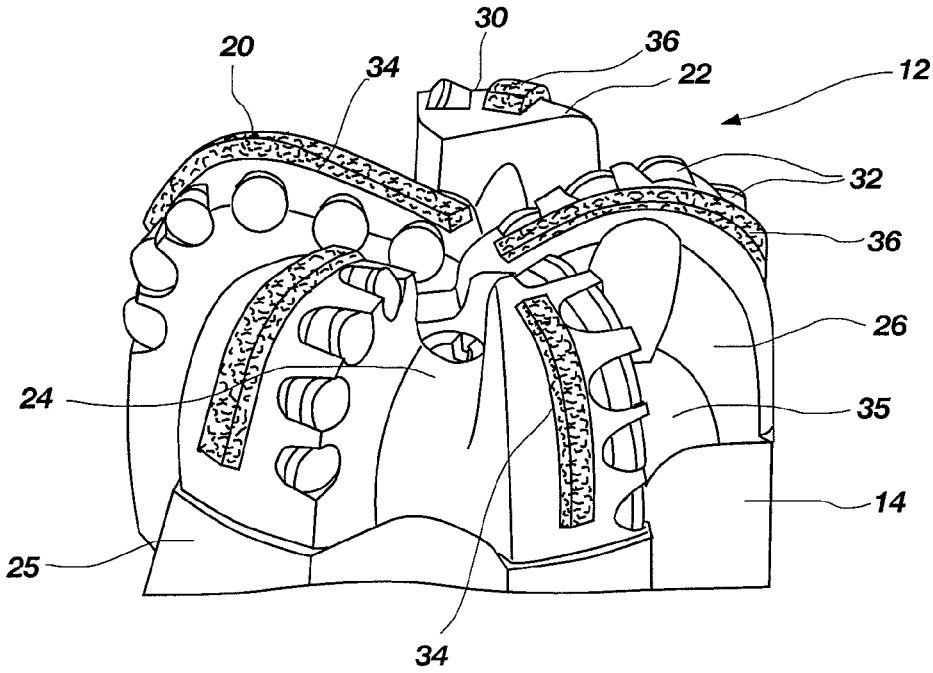
FIG. 4 shows a perspective view of a portion of another embodiment of a drill bit of the present disclosure.
Figure 5:
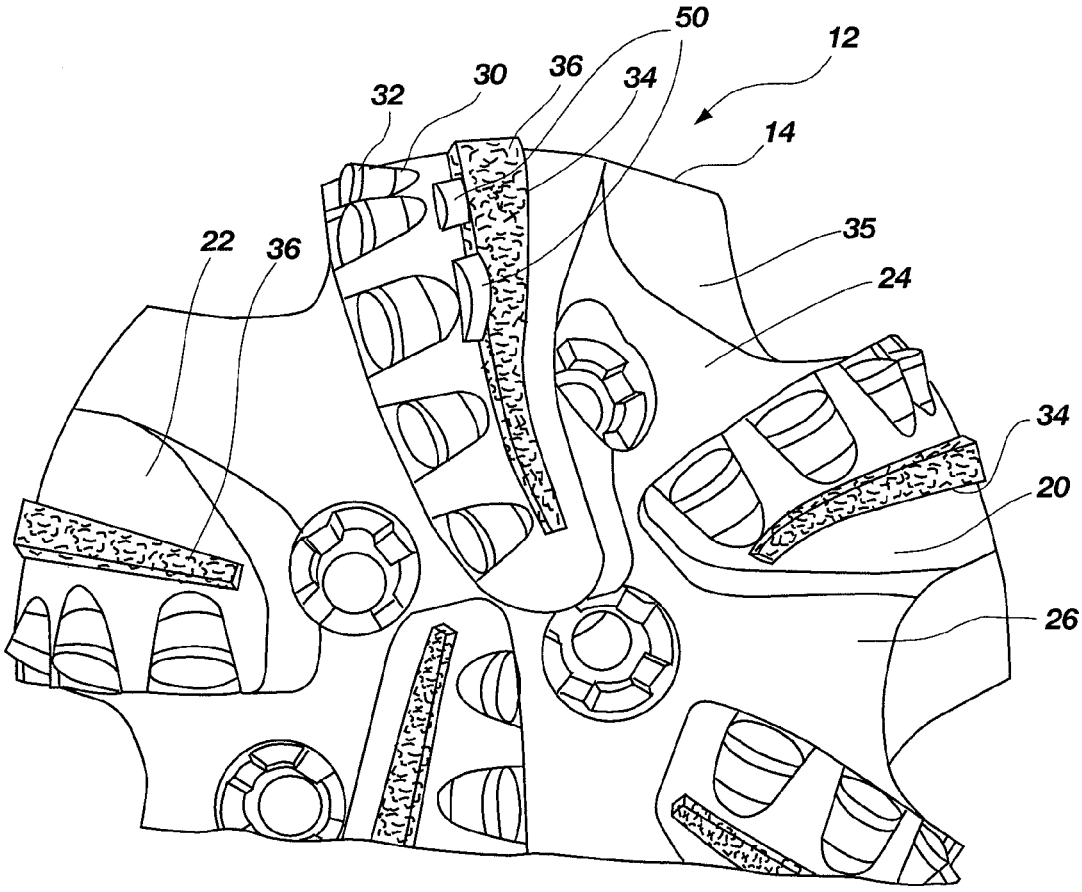
FIG. 5 shows an enlarged view of the face of a variation of the embodiment of FIG. 4.

In other embodiments, as shown in FIGS. 4, 5 and in at least portions of FIGS. 8-10, abrasive cutting structures 36 may be configured as single, elongated structures extending radially outward along blades 22. Similar to the wear knots, the elongated structures may be formed by melting the matrix material and shaping the material on the blade 22, or the elongated structures may comprise pre-formed structures which may be secured to the blade 22 by brazing. Furthermore, the elongated structures may similarly comprise surfaces that are rough and jagged to aid in engaging and comminuting elastomeric components.

It is desirable to select or tailor the thickness or thicknesses of abrasive cutting structures 36 to provide sufficient material therein to cut through one or more casing-associated components, such as an elastomeric component 37 (see FIGS. 6 and 7), a casing bit and casing, as well as combinations thereof between the interior of the casing and the surrounding formation to be drilled. In embodiments employing a plurality of abrasive cutting structures 36 configured as wear knots adjacent one another, the plurality of abrasive cutting structures 36 may be positioned such that each abrasive cutting structure 36 is associated with and positioned rotationally behind one or more cutting elements 32. The plurality of abrasive cutting structures 36 may be substantially uniform in size or the abrasive cutting structures 36 may vary in size. By way of example and not limitation, the abrasive cutting structures 36 may vary in size such that the cutting structures 36 positioned at more radially outward locations (and, thus, which traverse relatively greater distance for each rotation of drill bit 12 than those, for example, within the cone of drill bit 12) may be greater in size or at least in exposure so as to accommodate greater wear.

Similarly, in embodiments employing single, elongated structures on the blades 22, abrasive cutting structures 36 may be of substantially uniform thickness, taken in the direction of intended bit rotation, as depicted in, for example, FIG. 4, or abrasive cutting structures 36 may be of varying thickness, taken in the direction of bit rotation, as depicted in, for example, FIG. 5. By way of example and not limitation, abrasive cutting structures 36 at more radially outward locations may be thicker. In other embodiments, the abrasive cutting structures 36 may comprise a thickness to cover substantially the whole surface of a surface of the face (e.g. the whole surface of blades 22) behind the cutting elements 32.

In some embodiments, the abrasive cutting structures 36 may further include discrete cutters 50 (FIG. 5) disposed therein. The discrete cutters 50 may comprise cutters similar to those described in U.S. Patent Publication No. 2007/0079995, the disclosure of which is incorporated herein in its entirety by this reference. Other suitable discrete cutters 50 may include the abrasive cutting elements described in U.S. Patent Publication No. 2009/0084608. Another non-limiting example of suitable discrete cutters 50 may include a star-shaped carbide cutter sold under the trademark OPTI-CUT™ by Baker Oil Tools. In some embodiments, the discrete cutters 50 may be disposed on blades 22 with the cutting structures 36 such that the discrete cutters 50 have a relative exposure greater than the relative exposure of cutting structures 36, such that the discrete cutters 50 come into contact with casing components before the cutting structures 36. In other embodiments, the discrete cutters 50 and the cutting structures 36 have approximately the same relative exposure. In still other embodiments, the discrete cutters 50 have a relative exposure lower than the relative exposure of cutting structures 36. In embodiments where discrete cutters 50 have a lower relative exposure than the cutting structures 36, the discrete cutters 50 may be at least partially covered by the material comprising cutting structures 36. In still other embodiments, the discrete cutters 50 may be positioned rotationally behind or in front of the cutting structures 36.

Also as shown in FIGS. 1-5, abrasive cutting structures 36 may extend along an area from the cone of the bit out to the shoulder (in the area from the centerline L (FIGS. 6 and 7) to gage regions 25) to provide maximum protection for cutting elements 32, which are highly susceptible to damage when drilling casing assembly components. In other embodiments, such as those shown in FIGS. 8-10, abrasive cutting structures 36 may be disposed along an area from the cone of the bit out to the shoulder, but may be truncated flush with the gage regions 25. In this manner the abrasive cutting structures 36 can be located to engage an elastomeric component 37 (see FIGS. 6 and 7), while protecting the size of the borehole as is typically defined by the gage regions 25.

Cutting elements 32 and abrasive cutting structures 36 may be respectively dimensioned and configured, in combination with the respective depths and locations of pockets 30 and, when present, troughs 34, to provide abrasive cutting structures 36 with a greater relative exposure than superabrasive cutting elements 32. As used herein, the term "exposure" of a cutting element generally indicates its distance of protrusion above a portion of a drill bit, for example a blade surface or the profile thereof, to which it is mounted. However, in reference specifically to the present disclosure, "relative exposure" is used to denote a difference in exposure between a cutting element 32 and a cutting structure 36 (as well as a discrete cutter 50). More specifically, the term "relative exposure" may be used to denote a difference in exposure between one cutting element 32 and a cutting structure 36 (or discrete cutter 50) which, optionally, may be proximately located in a direction of bit rotation and along the same or similar rotational path. In the embodiments depicted in FIGS. 1-5, abrasive cutting structures 36 may generally be described as rotationally "following" superabrasive cutting elements 32 and in close rotational proximity on the same blade 22. However, abrasive cutting structures 36 may also be located to rotationally "lead" associated superabrasive cutting elements 32, to fill an area between laterally adjacent superabrasive cutting elements 32, or both.

Figure 6:
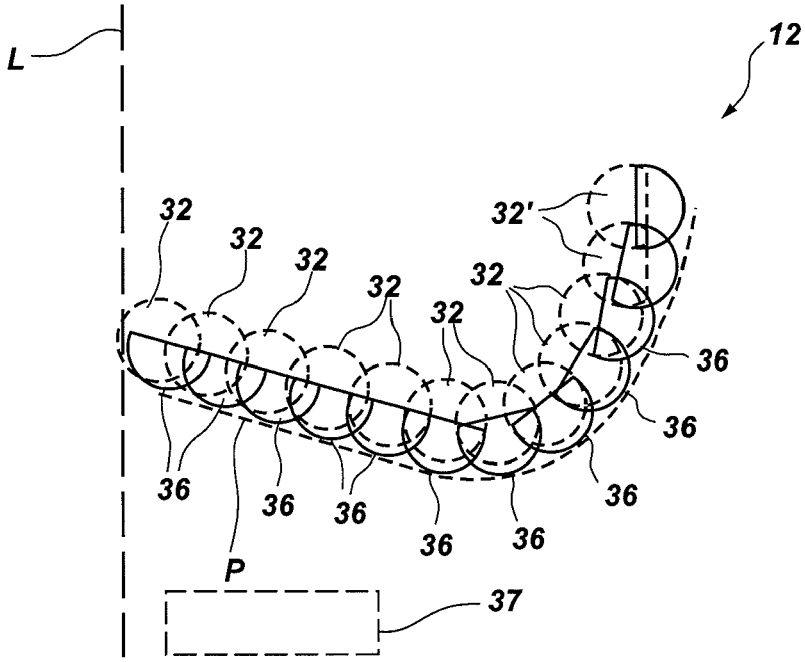
FIG. 6 shows a schematic side cross-sectional view of a cutting element placement design of a drill bit according to the embodiment of FIG. 1 showing relative exposures of cutting elements and cutting structures disposed thereon.
Figure 7:
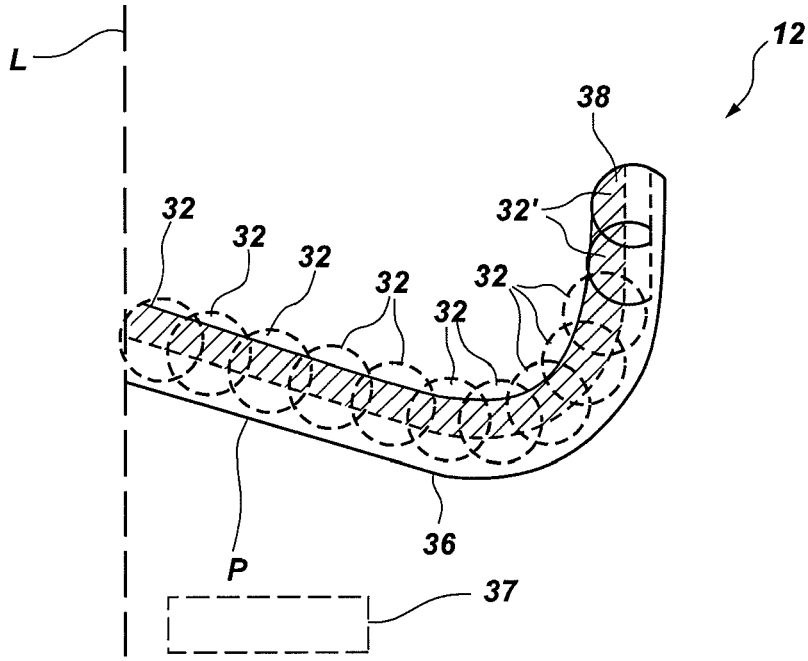
FIG. 7 shows a schematic side cross-sectional view of a cutting element placement design of a drill bit according to the embodiment of FIG. 4 showing relative exposures of cutting elements and a cutting structure disposed thereon.

By way of illustration of the foregoing, FIG. 6 shows a schematic side view of a cutting element placement design for drill bit 12 showing cutting elements 32, 32' and cutting structures 36 as disposed on a drill bit (not shown) such as an embodiment of drill bit 12 as shown in, for example, FIGS. 1-3. FIG. 7 shows a similar schematic side view showing cutting elements 32, 32' and cutting structure 36 as disposed on a drill bit (not shown) such as an embodiment of drill bit 12 as shown in, for example, FIGS. 4 and 5. Both of FIGS. 6 and 7 show cutting elements 32, 32' and cutting structures 36 in relation to the longitudinal axis or centerline L and drilling profile P thereof, as if all the cutting elements 32, 32', and cutting structures 36 were rotated onto a single blade (not shown). Furthermore, FIG. 10 shows an enlarged perspective view of a portion of a blade 22 showing cutting elements 32, 32' and cutting structures 36 as disposed on a portion of the drill bit 12 of FIGS. 8 and 9. As shown in FIGS. 6, 7, and 10, cutting structures 36 may be sized, configured, and positioned so as to engage and drill a first material or region, such as an elastomeric component 37 (shown schematically in dashed lines), as well as any other downhole component (e.g., casing, casing bit, casing-associated component). Further, the cutting structures 36 may be further configured to drill through a region of cement that surrounds a casing shoe, if it has been cemented within a well bore. In addition, a plurality of cutting elements 32 may be sized, configured, and positioned to drill into a subterranean formation beyond the elastomeric component 37 and other downhole components.

Cutting elements 32' are shown as configured with radially outwardly oriented flats and positioned to cut a gage diameter of drill bit 12. As shown in FIGS. 6 and 7, the gage region of the cutting element placement design for some embodiments of drill bit 12 may also include cutting structures 36 associated with the cutting elements 32'. However, in other embodiments, as illustrated in FIGS. 8 and 10, the gage region of the cutting element placement design for some embodiments of drill bit 12 may include cutting elements 32', but without associated cutting structures 36. The cutting structures 36 may instead be truncated proximate the gage region 25 to be at least substantially flush with the gage region 25.

The present invention contemplates that the cutting structures 36 may be more exposed than the plurality of cutting elements 32 over at least the nose and shoulder regions of the face 26. In this way, the cutting structures 36 may be sacrificial in relation to the plurality of cutting elements 32. Explaining further, the cutting structures 36 may be configured to initially engage and drill through materials and regions that are different from subsequent materials and regions that the plurality of cutting elements 32 is configured to engage and drill through.

Accordingly, the cutting structures 36 may comprise an abrasive material as described above, while the plurality of cutting elements 32 may comprise PDC cutting elements. Such a configuration may facilitate drilling through an elastomeric component 37 (see FIGS. 6 and 7), as well as casing and other casing-associated components (e.g., a shoe or bit, cementing equipment components within the casing on which the casing shoe or bit is disposed, cement, etc.) with primarily the cutting structures 36. However, upon passing into a subterranean formation, the abrasiveness of the subterranean formation material being drilled may rapidly wear away the material of cutting structures 36 to enable the plurality of PDC cutting elements 32 having a lesser exposure to engage the formation. As shown in FIGS. 1-5 and 8-10, one or more of the plurality of cutting elements 32 may rotationally precede the cutting structures 36, without limitation. Alternatively, one or more of the plurality of cutting elements 32 may rotationally follow the cutting structures 36.

Notably, after the material of cutting structures 36 has been worn away by the abrasiveness of the subterranean formation material being drilled, the PDC cutting elements 32 are relieved and may drill more efficiently. Further, the materials selected for the cutting structures 36 may allow the cutting structures 36 to wear away relatively quickly and thoroughly so that the PDC cutting elements 32 may engage the subterranean formation material more efficiently and without interference from the cutting structures 36.

In some embodiments, a layer of sacrificial material 38 (FIG. 7) may be initially disposed on the surface of a blade 22 or in optional pocket or trough 34 and the tungsten carbide of the one or more cutting structures 36 disposed thereover. Sacrificial material 38 may comprise a low-carbide or no-carbide material that may be configured to wear away quickly upon engaging the subterranean formation material in order to more readily expose the plurality of cutting elements 32. The sacrificial material 38 may have a relative exposure less than the plurality of cutting elements 32, but the one or more cutting structures 36 disposed thereon will achieve a total relative exposure greater than that of the plurality of cutting elements 32. In other words, the sacrificial material 38 may be disposed on blades 22, and optionally in a pocket or trough 34, having an exposure less than the exposure of the plurality of cutting elements 32. The one or more cutting structures 36 may then be disposed over the sacrificial material 38, the one or more cutting structures 36 having an exposure greater than the plurality of cutting elements 32. By way of example and not limitation, a suitable exposure for sacrificial material 38 may be two-thirds or three-fourths of the exposure of the plurality of cutting elements 32.

Referring specifically to FIGS. 8-10, several views of an embodiment of a drill bit 12 particularly configured for drilling casing-associated components comprising elastomeric materials are illustrated. Various embodiments of conventional casing and casing-associated components utilize one or more elastomeric components, as are commonly known in the art. For example, various conventional float shoes (e.g., casing shoes) may utilize one or more rubber plugs in cementing operations to separate a cement slurry from other fluids in the drill pipe. As described above, and as illustrated, the drill bit 12 comprises abrasive cutting structures 36 configured as wear knots or elongated structures, or combinations thereof. In at least some embodiments of drill bit 12 particularly configured for drilling elastomeric components, the plurality of particles may comprise at least coarse particles comprising substantially rough, jagged edges, as described above. By way of example and not limitation, the plurality of particles may comprise sizes selected from at least the range of sizes including about ½ inch particles to about 3/16 inch particles.

As generally set forth above, the relative exposure of the cutting structures 36 is selected to be sufficiently greater than the relative exposure of the cutting elements 32 so that the cutting structures 36 will engage a casing or casing-associated component while at least substantially inhibiting the cutting elements 32 from engaging the casing or casing-associated component. In embodiments configured to be employed for drilling one or more elastomeric components, the cutting structures 36 may be configured with a relative exposure sufficiently greater than the relative exposure of the cutting elements 32 to not only preclude the cutting elements 32 from engaging the elastomeric component 37 (see FIGS. 6 and 7), but to allow the rough and jagged hard particles to effectively engage and penetrate into the elastomeric component 37 (see FIGS. 6 and 7) while maintaining cutting elements 32 out of contact with the surface of the elastomeric component 37 (see FIGS. 6 and 7). By way of example and not limitation, in at least some embodiments, the cutting structures 36 may be configured to exhibit a relative exposure that is between about 3/16 inch and about ⅜ inch greater than the relative exposure of at least some of the plurality of cutting elements 32.

In use, the rough and jagged hard particles in the cutting structures 36 penetrate into the elastomeric component 37 (see FIGS. 6 and 7) and under bit rotation and weight-on-bit, comminute the elastomeric component 37 (see FIGS. 6 and 7) by grinding, shearing and shredding away relatively smaller pieces than would be removed by the cutting elements 32. As a result, the elastomeric component 37 (see FIGS. 6 and 7) may be drilled more effectively and relatively more quickly than by conventional means. By removing relatively smaller portions of the elastomeric component 37 (see FIGS. 6 and 7), the rough and jagged hard particles of the cutting structures 36 are capable of efficiently drilling through the elastomeric component 37 (see FIGS. 6 and 7) without substantially spinning the elastomeric component 37 (see FIGS. 6 and 7) and preventing drill out. Furthermore, the relatively smaller portions of the elastomeric component 37 (see FIGS. 6 and 7) may be more easily flushed away from the bit face, reducing and even eliminating balling of the drill bit 12.

In at least some embodiments, while drilling through one or more elastomeric components, the drill bit or tool may be employed at a relatively high rotational speed and a relatively low weight applied on the drill bit or tool (i.e., weight-on-bit (WOB)) in comparison to rotational speeds and WOB used for drilling a subterranean formation. By way of example and not limitation, the drill bit 12 may be rotated at a speed of about 90 RPM or greater with a WOB between about 5,000 lbs. and about 10,000 lbs.

While certain embodiments have been described and shown in the accompanying drawings, such embodiments are merely illustrative and not restrictive of the scope of the invention, and this invention is not limited to the specific constructions and arrangements shown and described, since various other additions and modifications to, and deletions from, the described embodiments will be apparent to one of ordinary skill in the art. Thus, the scope of the invention is only limited by the literal language, and legal equivalents, of the claims which follow.

What is claimed is:

1. An earth-boring tool, comprising:

a body having a face at a leading end thereof and a plurality of cutting elements disposed on a plurality of blades extending over the face; and a plurality of abrasive cutting structures comprising jagged surfaces disposed on the plurality of blades and positioned in association with at least some of the plurality of cutting elements, at least one abrasive cutting structure of the plurality of abrasive cutting structures rotationally behind at least one cutting element of the plurality of cutting elements on a common blade of the plurality of blades, the plurality of abrasive cutting structures comprising a composite material comprising a plurality of hard particles exhibiting a substantially rough surface in a matrix material, wherein a relative exposure of the plurality of abrasive cutting structures is sufficiently greater than a relative exposure of the at least some of the plurality of cutting elements to engage and at least partially penetrate into an elastomeric component while at least substantially inhibiting the plurality of cutting elements from engaging the elastomeric component.

2. The earth-boring tool of claim 1, wherein the plurality of abrasive cutting structures comprises one of a plurality of wear knots, a plurality of elongated abrasive cutting structures, and a plurality of wear knots and a plurality of elongated abrasive cutting structures on a surface of the body.

3. The earth-boring tool of claim 1, wherein the plurality of hard particles comprises at least one of a carbide and a ceramic material.

4. The earth-boring tool of claim 1, wherein the plurality of hard particles comprises a plurality of crushed hard particles.

5. The earth-boring tool of claim 1, wherein the plurality of abrasive cutters further comprises a sacrificial material, the sacrificial material being interposed between the body and the composite material.

6. The earth-boring tool of claim 1, further comprising a plurality of discrete cutters disposed proximate the plurality of abrasive cutting structures and rotationally behind the at least some of the plurality of cutting elements.

7. The earth-boring tool of claim 1, wherein the plurality of abrasive cutting structures are greater in exposure at radially outward locations than exposure of the plurality of abrasive cutting structures at radially inward locations.

8. The earth-boring tool of claim 1, wherein the plurality of abrasive cutting structures are positioned on the face along an area from a cone of the face to a shoulder and the plurality of abrasive cutting structures terminate proximate a gage region of the body to be at least substantially flush therewith.

9. The earth-boring tool of claim 1, wherein the relative exposure of the plurality of abrasive cutting structures is between about 3/16 inch and about 3/8 inch greater than the relative exposure of the at least some of the plurality of cutting elements.

10. A method of drilling with an earth-boring tool, comprising:

engaging and drilling an elastomeric component using a jagged surface of one of an elongated abrasive cutting structure, a plurality of wear knots, and an elongated abrasive cutting structure and a plurality of wear knots comprised of a composite material comprising a plurality of hard particles exhibiting a substantially rough surface in a matrix material attached to a blade; and subsequently engaging and drilling a subterranean formation using a plurality of cutting elements attached to the blade exhibiting a relative exposure less than a relative exposure of the one of the elongated abrasive cutting structure, the plurality of wear knots, and the elongated abrasive cutting structure and the plurality of wear knots, the plurality of cutting elements rotationally leading the one of the elongated abrasive cutting structure, the plurality of wear knots, and the elongated abrasive cutting structure and the plurality of wear knots.

11. The method of claim 10, wherein engaging and drilling the elastomeric component comprises forcing at least some of the plurality of hard particles exhibiting a substantially rough surface to penetrate at least partially into the elastomeric component without engaging the elastomeric component with the plurality of cutting elements.

12. The method of claim 10, further comprising engaging and drilling another casing component using the jagged surface of the one of the elongated abrasive cutting structure, the plurality of wear knots, and the elongated abrasive cutting structure and the plurality of wear knots prior to engaging and drilling the subterranean formation.

13. The method of claim 10, wherein engaging and drilling the elastomeric component comprises rotating the earth-boring tool at about 90 RPM or greater.

14. The method of claim 10, wherein engaging and drilling the elastomeric component comprises applying a weight between about 5,000 pounds and about 10,000 pounds on the earth-boring tool.

15. The method of claim 10, wherein engaging and drilling the elastomeric component using the jagged surface of the one of the elongated abrasive cutting structure, the plurality of wear knots, and the elongated abrasive cutting structure and the plurality of wear knots comprises engaging and drilling the elastomeric component using the jagged surface of the one of the elongated abrasive cutting structure disposed in at least one trough in a body of an earth-boring tool, the plurality of wear knots disposed in a plurality of pockets in the body, and the elongated abrasive cutting structure disposed in at least one trough in the body and the plurality of wear knots disposed in the plurality of pockets in the body.

16. The method of claim 10, wherein engaging and drilling the elastomeric component using the jagged surface of the one of the elongated abrasive cutting structure, the plurality of wear knots, and the elongated abrasive cutting structure and the plurality of wear knots comprises engaging and drilling the elastomeric component using the jagged surface of the one of the elongated abrasive cutting structure, the plurality of wear knots, and the elongated abrasive cutting structure and the plurality of wear knots disposed over a sacrificial material.

17. The method of claim 10, wherein engaging and drilling the elastomeric component using the jagged surface of the one of the elongated abrasive cutting structure, the plurality of wear knots, and the elongated abrasive cutting structure and the plurality of wear knots comprised of a composite material comprising a plurality of hard particles exhibiting a substantially rough surface in a matrix material comprises engaging and drilling the elastomeric component using the jagged surface of the one of the elongated abrasive cutting structure, the plurality of wear knots, and the elongated abrasive cutting structure and the plurality of wear knots comprised of a composite material comprising a plurality of hard particles comprising a carbide selected from the group consisting of W, Ti, Mo, Nb, V, Hf, Ta, Cr, Zr, Al, and Si.

18. A method of drilling with an earth-boring tool, comprising:

comminuting an elastomeric component into sufficiently small pieces to enable removal of the pieces from a face of the earth-boring tool, the elastomeric component being comminuted using jagged surfaces defined by a plurality of abrasive cutting structures comprising a plurality of hard particles exhibiting a substantially rough surface in a matrix material attached to a blade; and subsequently engaging and drilling a subterranean formation using a plurality of cutting elements attached to the blade exhibiting a relative exposure less than a relative exposure of the plurality of abrasive cutting structures, at least one cutting element of the plurality of cutting elements rotationally leading at least one abrasive cutting structure of the plurality of abrasive cutting structures.

19. The method of claim 18, wherein comminuting the elastomeric component using jagged surfaces defined by a plurality of abrasive cutting structures comprises forcing at least some of the jagged surfaces to penetrate at least partially into the elastomeric component without engaging the elastomeric component with the plurality of cutting elements.

20. The method of claim 18, further comprising engaging and drilling at least one additional casing component using the plurality of abrasive cutting structures.

* * * * *